US009194342B2

(12) United States Patent
Volckart et al.

(10) Patent No.: US 9,194,342 B2
(45) Date of Patent: Nov. 24, 2015

(54) INTERNAL COMBUSTION ENGINE HAVING AN INTAKE DEVICE

(71) Applicant: ANDREAS STIHL AG & CO. KG, Waiblingen (DE)

(72) Inventors: Lutz Volckart, Fellbach (DE); Michael Grether, Waiblingen (DE)

(73) Assignee: ANDREAS STIHL AG & CO. KG, Waiblingen (DE)

( * ) Notice: Subject to any disclaimer, the term of this patent is extended or adjusted under 35 U.S.C. 154(b) by 0 days.

(21) Appl. No.: 14/211,449

(22) Filed: Mar. 14, 2014

(65) Prior Publication Data

US 2014/0261277 A1 Sep. 18, 2014

(30) Foreign Application Priority Data

Mar. 15, 2013 (DE) ..... 10 2013 004 875

(51) Int. Cl.
*F02M 35/10* (2006.01)

(52) U.S. Cl.
CPC ..... *F02M 35/10* (2013.01)

(58) Field of Classification Search
CPC ..... F02M 35/02; F02M 35/10262; F02M 35/104; F02B 63/02
USPC ..... 123/184.21, 41.65, 73 PP, 73 C, 552
See application file for complete search history.

(56) References Cited

U.S. PATENT DOCUMENTS

| | | | | |
|---|---|---|---|---|
| 2,396,317 | A * | 3/1946 | Cutts | 123/552 |
| 6,814,032 | B2 * | 11/2004 | Goto | 123/27 GE |
| 7,228,825 | B2 * | 6/2007 | Hoche et al. | 123/73 PP |
| 8,141,536 | B2 * | 3/2012 | Tsunoda | 123/198 E |
| 2012/0312270 | A1 * | 12/2012 | Kaiser et al. | 123/184.21 |
| 2013/0255616 | A1 * | 10/2013 | Yao | 123/184.21 |
| 2013/0306018 | A1 * | 11/2013 | von Krane et al. | 123/184.21 |

FOREIGN PATENT DOCUMENTS

| | | | |
|---|---|---|---|
| DE | 10 2004 056 149 | A1 | 5/2006 |
| JP | 2003254177 | A * | 9/2003 |

* cited by examiner

*Primary Examiner* — Lindsay Low
*Assistant Examiner* — Long T Tran
(74) *Attorney, Agent, or Firm* — Paul D. Strain, Esq.; Strain & Strain PLLC

(57) ABSTRACT

An internal combustion engine has an intake device having an air filter and at least one port. Combustion air is sucked in from the clean side of the air filter to the internal combustion engine via the port. The intake device has air trunking, in which at least a first section and a second section of the port are guided. The air trunking has a longitudinal center axis, wherein combustion air flows in the first section of the port in a first direction of flow running in the direction of the longitudinal center axis. The combustion air flows in the second section of the port in a second direction of flow oriented in an opposite direction to the first direction of flow and in the direction of the longitudinal center axis. As a result, a compact overall size is achieved with port length.

19 Claims, 6 Drawing Sheets

INTERNAL COMBUSTION ENGINE HAVING AN INTAKE DEVICE

CROSS-REFERENCE TO RELATED PATENT APPLICATIONS

This application is based upon and claims the benefit of priority from prior German Patent Application No. 10 2013 004 875.3, filed Mar. 15, 2013, the entire contents of which are incorporated herein by reference in their entirety.

BACKGROUND

This application relates to an internal combustion engine having an intake device having an air filter and at least one port. In an exemplary embodiment, combustion air is sucked in from the clean side of the air filter to the internal combustion engine via the port. The intake device has air trunking, in which at least a first section and a second section of the port are guided. The air trunking has a longitudinal center axis, wherein the combustion air flows in the first section of the port in a first direction of flow. The first direction of flow runs in the direction of the longitudinal center axis. The combustion air flows in the second section of the port in a second direction of flow which is oriented in the opposite direction to the first direction of flow and in the direction of the longitudinal center axis.

DE 10 2004 056 149 A1 discloses a combustion engine, specifically a two-stroke engine, the intake device of which has an air filter and an air port and a mixture port. The lengths of the air port and mixture port are coordinated with one another in order to influence the pressure waves that form in the ports during operation. To this end, the air port and mixture port are extended into the clean space of the air filter. In the clean space of the air filter, the ports extend in a plane which extends parallel to the plane of the filter material of the air filter.

This application is based on the object of creating an internal combustion engine having an intake device of the generic type, which has a simple and compact structure.

SUMMARY OF PREFERRED EMBODIMENTS

This object is achieved by an internal combustion engine having an intake device according to the present application.

In one exemplary embodiment of the present application, the intake device has at least one port, via which combustion air is sucked in from the clean side of an air filter to the internal combustion engine. At least two sections of the port are guided in the air trunking of the intake device. The direction of flow in each of two sections of the port runs in this case in the direction of the longitudinal center axis, wherein the direction of flow in the second section runs in the opposite direction to the direction of flow in the first section. As a result of the opposite direction of flow in the two sections and the orientation of the direction of flow in the direction of the longitudinal center axis of the air trunking, a compact structure is produced. A very long length of the port in a small installation space can be realized. Since both sections of the port are guided in the air trunking, it is easy to seal off the two sections of the port from the environment. Leaks between the ports merely result in bypass air being sucked in within the intake device. As a result, the sealing between the ports can be formed easily.

In another embodiment, advantageously, the air trunking extends through the air filter. This results in a simple and compact structure. Both the installation space available on the dirty side and also the installation space available on the clean side of the air filter can be used for the air trunking. The air filter designates in the present case the filter material that removes dirt. Advantageously, the first and second sections of the port extend through the air filter. In particular, a third section of the port is guided in the air trunking, wherein the direction of flow in the third section corresponds to the direction of flow in the first section. Accordingly, the port is arranged in a twice-folded manner in the air trunking. The air filter extends advantageously in a plane which encloses an angle of less than 90° with the longitudinal center axis of the air trunking. The angle between the plane of the air filter and the longitudinal center axis of the air trunking is advantageously from about 40° to about 80°. On account of the inclination of the plane of the air filter with respect to the longitudinal center axis of the air trunking, a large effective filter area can be accommodated in a small installation space. The air filter is advantageously a nonwoven filter. However, the air filter may also be a paper filter, for example and without limitation a folded filter, or another type of air filter. The plane of the air filter is a plane which intersects the installation space taken up by the air filter. The plane of the air filter intersects the installation space of the air filter advantageously centrally.

In yet another embodiment, a simple structure is produced when the sections of the port in the air trunking are separated from one another by at least one intermediate wall of the air trunking. In this case, at least one intermediate wall is advantageously integrally formed on the air trunking. Since the direction of flow in the sections of the port runs in the direction of the longitudinal center axis of the air trunking, the intermediate walls also extend approximately in this direction. As a result, it is possible to easily produce the air trunking with at least one intermediate wall from plastics material, for example and without limitation, in an injection-molding process, and remove it from the injection mold. Advantageously, the port extends in a straight line in the first section and in the second section. Advantageously, a deflecting section, at which the flow is deflected from the first direction of flow into the second direction of flow, is arranged between the first and the second section. Accordingly, a deflection of the flow through 180°, that is to say into the opposite direction, takes place in the deflecting section. The deflecting section has advantageously a curved deflecting face. The deflecting face is curved in particular in a concave manner. As a result, the flow resistance can be kept low, in spite of the strong deflection of the flow.

In still another embodiment, a simple structure of the intake device is produced when a cover component is arranged on the air trunking. The sections of the port that are guided in the air trunking are advantageously bounded by the air trunking and the cover component. The sections of the port that are guided in the air trunking are in particular bounded only by the air trunking and the cover component. This results in a small number of necessary individual parts. On account of the orientation of the direction of flow in the first and second sections of the port, the cover component can also be produced in an injection-molding process and also removed from the mold. A simple structure is produced when an intermediate wall is held on the cover component, said intermediate wall projecting into the air trunking and separating two sections of the port from one another. Advantageously, intermediate walls are integrally formed both on the air trunking and on the cover component. This makes it possible to produce the air guiding component and cover component in one injection-molding process. However, it may also be advantageous to form one or more intermediate walls, which separate the sections of the ports from one another, on one or more components that are separate from the cover component and the air trunking. Advantageously, a deflecting section is formed on the cover component.

In a further embodiment, the intake device advantageously has a mixture port, into which fuel is fed, and an air port, which serves to feed scavenging air into at least one transfer port of the internal combustion engine. Accordingly, the internal combustion engine is an internal combustion engine that operates with stratified scavenging, in particular a two-stroke engine. Advantageously, both the mixture port and the air port are guided in the air trunking. This results in a simple, compact structure. The port which has the first section and the second section is preferably the mixture port. However, provision may also be made for the air port to have the first section and the second section. It may also be advantageous for both the air port and the mixture port to have a first and a second section, in which the direction of flow runs in opposite directions. A simple structure is produced when the air port and the mixture port open onto the clean side of the air filter at an end side of the air trunking.

In yet a further embodiment, advantageously, the intake duct has a carburetor for feeding fuel. Advantageously, a compensation port, which is connected to a compensation connection of the carburetor, is guided in the air trunking. The carburetor is advantageously a diaphragm carburetor and the compensation connection serves to compensate for pressure differences which arise on account of the soiling of the air filter. In order to avoid fuel being able to pass from the mixture port into the compensation port on account of pulsations in the mixture port, provision is advantageously made for the compensation port to be covered at the end side of the air trunking and to open, transversely to the longitudinal center axis of the air trunking, onto the clean side of the air filter. In this case, the compensation port opens onto the clean side of the air filter advantageously on the side that is remote from the mixture port opening.

In still yet a further embodiment, a simple structure is produced when the air port and the mixture port are guided in the carburetor in a common port pipe of the carburetor housing. In this case, the air port and the mixture port can be separated at least partially from one another by a partition wall arranged in the carburetor housing. The carburetor is advantageously arranged such that the direction of flow in the first section of the port encloses an angle of more than about 45° with the direction of flow in the carburetor. Advantageously, the angle is more than about 75°.

In yet another embodiment the air trunking extends through the air filter. Advantageously, the first section and the second section of the port may extend through the air filter, and a third section of the port is guided in the air trunking, in which the direction of flow in the third section corresponds to the direction of flow in the first section. In an embodiment, the air filter extends in a plane which encloses an angle ($\alpha$) of less than 90° with the longitudinal center axis of the air trunking. In a nonlimiting example, the sections of the port in the air trunking are separated from one another by at least one intermediate wall. A configuration may also be provided whereby the port extends in a straight line in the first section and in the second section, and a deflecting section is arranged between the first section and the second section. In an embodiment, a curved deflecting face may also be arranged at the deflecting section. In one instance, a cover component may be arranged on the air trunking, and the sections of the port that are guided in the air trunking are bounded by the air trunking and the cover component. Provision may also be made for an intermediate wall fixed to the cover component, whereby the intermediate wall projects into the air trunking and separates the two sections of the port from one another. The intermediate wall may optionally also be guided in at least one groove in the air trunking. A deflecting section may also be formed on the cover component.

In still another embodiment, the internal combustion engine may have a mixture port, into which fuel is fed. The intake device may also have an air port, which serves to feed scavenging air into at least one transfer port of the internal combustion engine. In such configuration, the mixture port and the air port may be guided in the air trunking. Provision may also be bade for the port which has the first section and the second section to be the mixture port. One example provides for the air port and the mixture port open onto the clean side of the air filter at an end side of the air trunking.

In yet a further embodiment, the intake device has a carburetor for feeding fuel. Such a configuration may include a compensation port connected to a compensation connection of the carburetor that is guided in the air trunking. Such compensation port may also be covered at the end side of the air trunking and may open, transversely to the longitudinal center axis of the air trunking, onto the clean side of the air filter. In one embodiment, the air port and the mixture port are guided in the carburetor in a common port pipe of the carburetor housing. Provision may also be made for the direction of flow in the first section of the port to enclose an angle ($\beta$) of more than about 45° with the direction of flow in the carburetor.

Further objects, features, and advantages of the present application will become apparent form the detailed description of preferred embodiments which is set forth below, when considered together with the figures of drawing.

BRIEF DESCRIPTION OF THE DRAWINGS

Exemplary embodiments of the present application are explained in the following text with reference to the figures of drawing, in which.

DETAILED DESCRIPTION OF PREFERRED EMBODIMENTS

Figure 1:
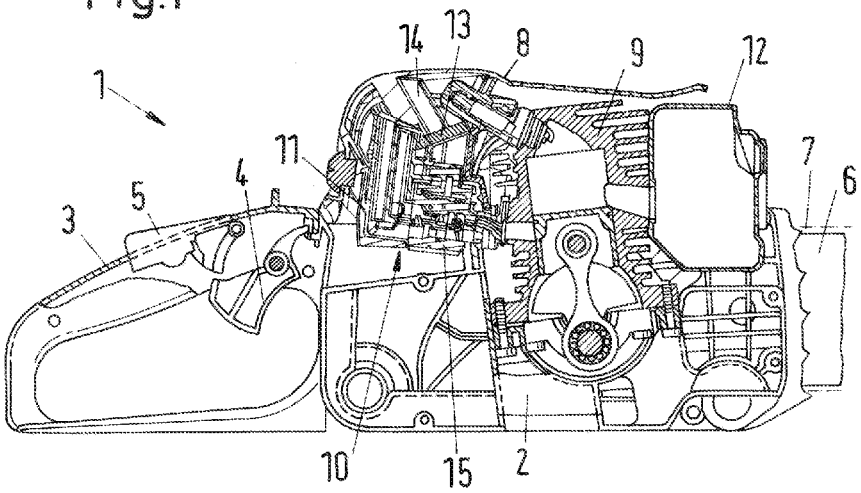
FIG. 1 shows a schematic sectional illustration through a chainsaw.

Turning to the figures of drawing, FIG. 1 shows a chainsaw 1 as an exemplary embodiment of a hand-held work apparatus. Instead of a chainsaw 1, provision can also be made of some other hand-held work apparatus, for example and without limitation, a cut-off grinder, a brushcutter, a blowing apparatus, hedge shears or the like. The chainsaw 1 has a housing 2, to which a handle 3 is secured. The handle 3 is configured as a rear handle in the exemplary embodiment. It may also be advantageous to configure the handle as a top handle. In addition, a handlebar (not shown) can be provided to guide the chainsaw 1 during operation.

A throttle lever 4 and a throttle lever lock 5 are mounted pivotably on the handle 3. The throttle lever serves to operate an internal combustion engine 9 arranged in the housing 2. The internal combustion engine 9 drives a saw chain 7, which is arranged in a circulating manner on a guide bar 6 secured to the housing 2.

The internal combustion engine 9 has an intake device 10, which comprises an air guiding component 11 and an air filter 13. The air filter 13 is held on the air guiding component 11. The clean side 14 of the air filter 13 is bounded by a hood 8 of the housing 2 of the chainsaw 1. In the exemplary embodiment, the filter 13 is a nonwoven filter. However, the air filter 13 can also be a paper filter, for example and without limitation, a folded filter, or other type of filter. Some other configuration of the air filter 13 may also be advantageous. In order to feed fuel to the combustion air sucked in via the intake device 10, provision is made of a carburetor 15, which is arranged between the air guiding component 11 and the internal combustion engine 9. Arranged on the internal combustion engine 9 is an exhaust muffler 12, via which the exhaust gases escape from the internal combustion engine 9 into the environment.

Figure 2:
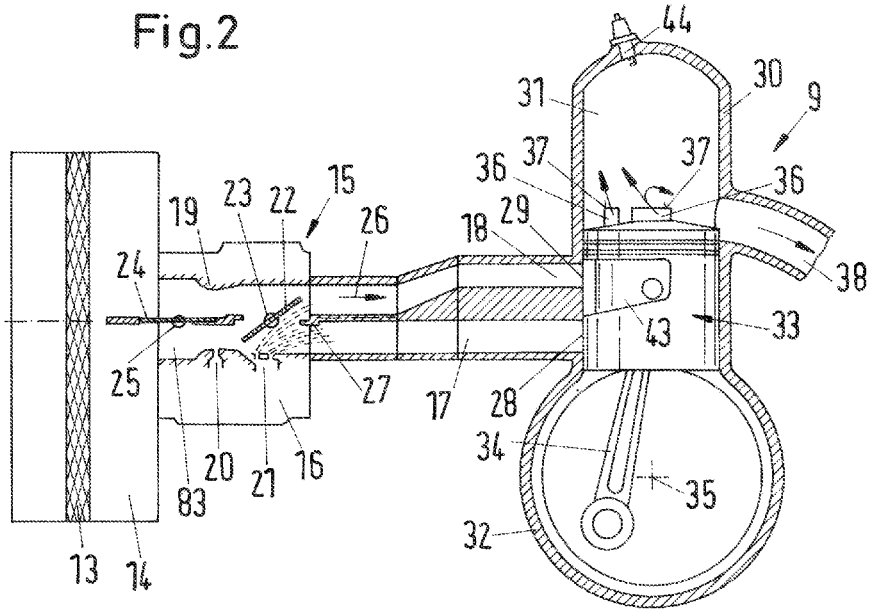
FIG. 2 shows a schematic illustration of the internal combustion engine of the chainsaw from FIG. 1.

FIG. 2 schematically shows an embodiment of the structure of the internal combustion engine 9 with the carburetor 15 and the air filter 13. The air guiding component 11 is not shown in FIG. 2 for the sake of simpler illustration. The carburetor 15 has a carburetor housing 16 which has a port 83. A throttle flap 22 having a throttle shaft 23 is mounted pivotably in the port 83. A choke flap 24 having a choke shaft 25 is mounted pivotably upstream of the throttle flap 22. The port 83 is divided by a partition wall 27 into an air port 18 and a mixture port 17. The partition wall 27 extends both in the port 83 in the carburetor housing 16 and also downstream of the carburetor 15. Provision can be made for the partition wall 27 to extend only downstream of the throttle flap 22. In the exemplary embodiment, the partition wall 27 is extended into the clean space 14 of the air filter 13.

Formed in the carburetor 15 is a venturi 19, in the region of which a main fuel opening 20 opens into the port 83. The main fuel opening 20 opens into the mixture port 17. Downstream of the main fuel opening 20, a plurality of secondary fuel openings 21 open in the carburetor 15 into the mixture port 17. Combustion air and fuel/air mixture flow from the carburetor 15 to the internal combustion engine 9 in a direction of flow 26 during operation.

The internal combustion engine 9 has a cylinder 30, in which a piston 33 is mounted in a reciprocating manner. The piston 33 bounds a combustion chamber 31 formed in the cylinder 30 and drives, via a connecting rod 34, a crankshaft mounted in a rotatable manner in a crankcase 32. The internal combustion engine 9 is configured as a two-stroke engine, specifically as a single cylinder engine. The internal combustion engine 9 has a plurality of transfer ports 36, which each open into the combustion chamber 31 by way of a transfer window 37. The transfer windows 37 are controlled by the piston 33 and are open toward the combustion chamber 31 in the region of the top dead center of the piston 33 and closed with respect to the combustion chamber 31 in the region of the bottom dead center of the piston 33.

As FIG. 2 shows, the piston 33 has a piston pocket 43, which is configured as a depression in the circumference of the piston 33. In the region of the top dead center of the piston 33, the piston pocket 43 connects an air inlet 29, by way of which the air port 18 opens out at the cylinder 30, to the transfer windows 37. The mixture port 17 opens into the interior of the crankcase 32 by way of a mixture inlet 28 likewise controlled by the piston 33. The mixture inlet 28 is in this case open toward the interior of the crankcase 32 in the region of the top dead center of the piston 33 and is closed with respect to the interior of the crankcase 32 in the region of the bottom dead center of the piston 33.

During operation, fuel/air mixture is sucked in from the mixture port 17 into the interior of the crankcase 32 when the piston 33 is in the region of its top dead center. At the same time, via the piston pocket 43, air from the airport 18 is temporarily stored in the transfer ports 36 via the transfer windows 37. During the movement of the piston 33 in the direction of its bottom dead center, the fuel/air mixture in the interior of the crankcase 32 is compressed. As soon as the piston 33 opens the transfer windows 37 toward the combustion chamber 31, first of all the air temporarily stored in the transfer ports 36 flows out of the air port 18 into the combustion chamber 31 and flushes exhaust gases, which are present in the combustion chamber 31 from the preceding engine cycle, out of the combustion chamber 31 through an outlet 38. Subsequently, fresh fuel/air mixture flows from the interior of the crankcase 32 into the combustion chamber 31 via the transfer ports 36.

During the upward stroke of the piston 33, that is to say during the movement of the piston 33 in the direction of its top dead center, the fuel/air mixture in the combustion chamber 31 is compressed. In the region of the top dead center of the piston 33, the mixture in the combustion chamber 31 is ignited by a spark plug 44 that projects into the combustion chamber 31. The subsequent combustion accelerates the piston 33 in the direction of its bottom dead centre. As soon as the outlet 38 is opened by the piston 33, the exhaust gases flow out of the combustion chamber 31 and are flushed out of the combustion chamber 31 by the air that is temporarily stored in the transfer ports 36 and flows into the combustion chamber 31 once the transfer windows 37 have been opened.

Fuel can also be fed to the internal combustion engine 9 via the air port 18. The fuel/air mixture fed via the air port 18 is in this case lower in fuel than the fuel/air mixture fed via the mixture port 17. Advantageously, at full load, the combustion air fed via the air port 18 is largely free of fuel.

Provision can also be made of an internal combustion engine 9 which has only one port for connecting the clean side 14 of the air filter 13 to the internal combustion engine 9. This port may be a mixture port, to which fuel is fed via a carburetor or a fuel valve. However, the port may also be just an air port and the fuel feed to the internal combustion engine 9 may take place via a fuel valve into the interior of the crankcase 32, into one or more transfer ports 36 or directly into the combustion chamber 31.

Figure 3:
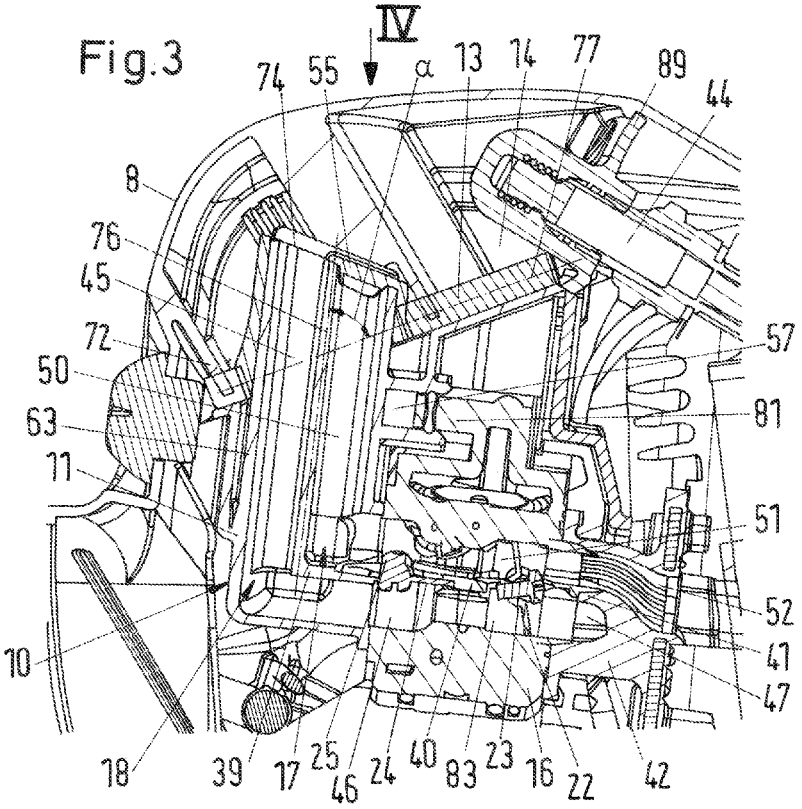
FIG. 3 shows a section through the intake device and the carburetor of the chainsaw from FIG. 1.
Figure 4:
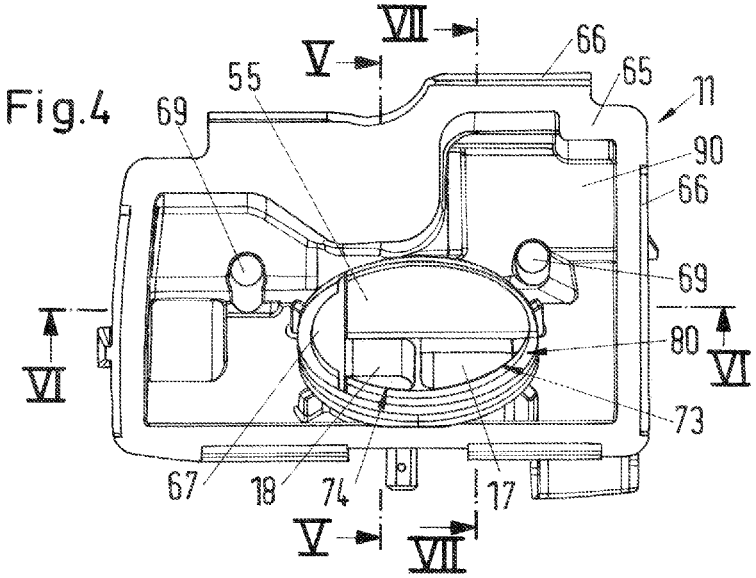
FIG. 4 shows a side view of the intake device from FIG. 3 in the direction of the arrow IV in FIG. 3 without the air filter.

FIG. 3 shows the structure of an embodiment of the intake device 10 in detail. The air guiding component 11 connects the port 83 in the carburetor 15 to the clean space 14 of the air filter 13. The air port 18 and the mixture port are guided in the air guiding component 11. The air guiding component 11 has air trunking 63, the outer wall of which, as FIG. 4 shows, has an approximately oval cross-sectional shape. A first section 45 of the air port 18 is guided in the air trunking 63. The first section 45 of the air port 18 extends approximately parallel, in particular exactly parallel, to a longitudinal center axis 76 of the air trunking 63. A second section 46 of the air port 18 is guided in the air guiding component 11 and in the carburetor housing 16. The second section 46 extends transversely to the first section 45 of the air port 17. In the exemplary embodiment, the sections 45 and 46 are oriented approximately perpendicularly to one another. A third section 47 of the air port 17 is guided in a connection piece 42 which connects the carburetor 15 to the internal combustion engine 9. In the exemplary embodiment, the connection piece 42 is formed in an elastic manner.

The partition wall 27 (FIG. 2) between the air port 18 and the mixture port 17 has a first partition wall section 39, which is integrally formed on the air guiding component 11. A second partition wall section 40 extends between the choke flap 24 and the throttle shaft 23. In the exemplary embodiment, the partition wall section 40 projects as far as the choke shaft 25. A third partition wall section 41 extends downstream of the throttle shaft 23 and is integrally formed on the elastic connection piece 42.

The mixture port 17, too, has a plurality of sections, of which FIG. 3 shows the third, fourth and fifth sections in the direction of flow. A third section 50 of the mixture port 17 extends approximately parallel to the longitudinal center axis 76 in the air trunking 63 of the air guiding component 11. A fourth section 51 of the mixture port extends in the carburetor housing 16 and in the air guiding component 11. The fourth section 51 of the mixture port 17 extends approximately parallel to the second section 46 of the air port 18 and transversely to the third section 50 of the mixture port 17. A fifth section 52 of the mixture port 17 is guided in the connection piece 42.

The third section 50 of the mixture port 17 does not open onto the clean side 14 of the air filter 13, but is closed with respect to the clean side 14 by a cover component 55. As FIG. 3 also shows, the air trunking 63 projects through the air filter 13. The air filter 13 has a plane 77, which is the mid-plane of the air filter 13. The plane 77 of the air filter 13 intersects the air trunking 63. The plane 77 encloses an angle $\alpha$ of less than 90° with the longitudinal center axis 76 of the air trunking 63. Advantageously, the angle $\alpha$ is from about 40° to about 80°. In the exemplary embodiment, the angle $\alpha$ is 60° to 65°. The clean space 14 of the air filter 13 is bounded by the hood 8. The spark plug 44 projects into the clean space 14 and is separated from the clean space 14 by a rubber element 89 and held against the latter. Arranged on the hood 8 is a holding connection piece 72 which presses against the air filter 13 and seals off the clean space 14 of the air filter 13. The holding connection piece 72 extends advantageously around the majority of the circumference of the air filter 13, so that good sealing is achieved.

The air guiding component 11 extends the effective port lengths of the air port 18 and mixture port 17. By coordination of the port lengths, a good, uniform supply of the internal combustion engine 9 with fuel and combustion air can be achieved over the entire speed range of the internal combustion engine 9. In this case, in the exemplary embodiment, the length of the air port 18 that is guided in the air guiding component 11 is much shorter than the length of the mixture port 17 that is guided in the air guiding component 11. However, other length ratios of the mixture port 17 and airport 18 may also be advantageous. It may also be advantageous, in the case of an internal combustion engine which has only one port for feeding combustion air or fuel/air mixture, to coordinate the port lengths, for example and without limitation, in order to achieve a sufficient negative pressure at a fuel opening that opens into the port, for a good fuel supply.

FIGS. 4 to 7 show an embodiment of the structure of the air guiding component 11, with the cover component 55 arranged thereon, in detail. As FIGS. 3 and 4 show, the mixture port 17 opens by way of a mixture port opening 73 onto the clean side 14 of the air filter 13. The mixture port opening 73 is arranged in front of the plane of the drawing in FIG. 3. The airport 18 opens by way of an air port opening 74, also shown in FIG. 3, onto the clean side 14 of the air filter 13. The airport opening 74 and the mixture port opening 73 are arranged on an end side 80 of the air trunking 63. The air guiding component 11 has a base 90, which bounds the dirty space of the air filter 13 and into which ambient air is sucked. Also formed on the air guiding component 11 is a bearing surface 65 for the air filter 13, said bearing surface 65 extending along the rim of the air filter 13. The bearing surface 65 is bounded by a partially interrupted positioning rim 66 which positions the air filter on the air guiding component 11. In the exemplary embodiment, two supporting connection pieces 69, on which the air filter 13 rests, extend from the base 90. As FIG. 4 also shows, the cover component 55 has a covering wall 67, which will be described in more detail in the following text.

Figure 5:
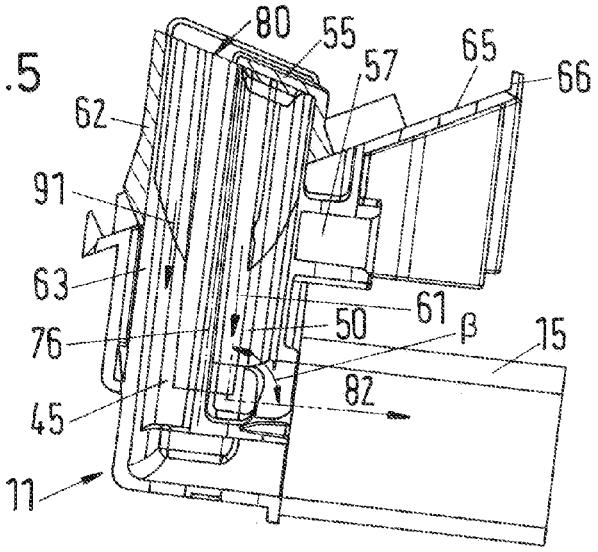
FIG. 5 shows a section along the line V-V in FIG. 4.
Figure 6:
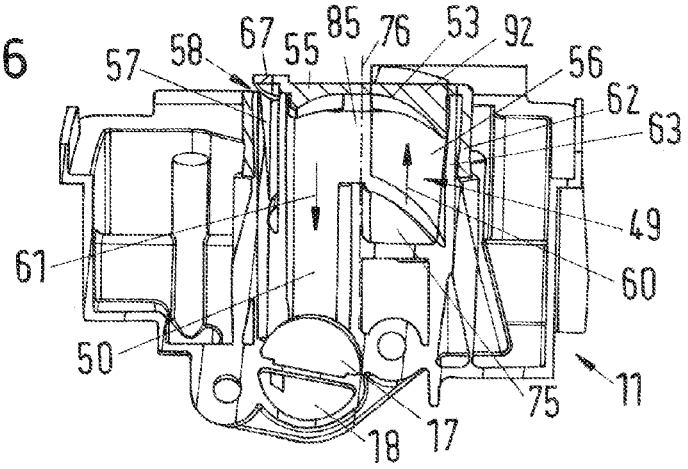
FIG. 6 shows a section along the line VI-VI in FIG. 4.
Figure 7:
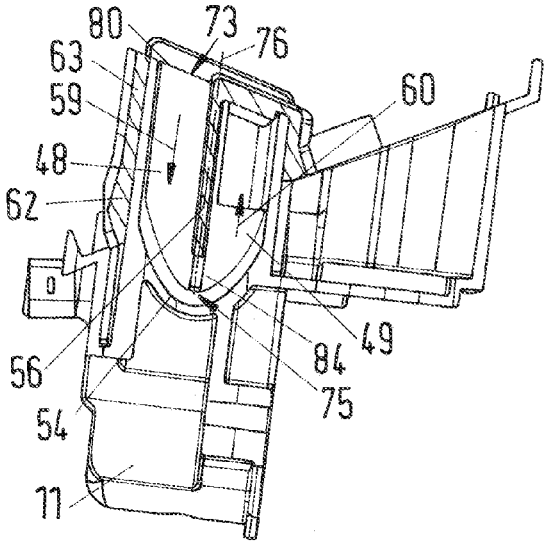
FIG. 7 shows a section along the line VII-VII in FIG. 4.

As FIGS. 5 to 7 show, in an exemplary embodiment, the cover component 55 has a rim 62, which engages over the air trunking 63. In the first section 45 of the air port 18, the sucked-in combustion air flows in a direction of flow 91 which is oriented in the direction of the longitudinal center axis 76. In the third section 50 of the mixture port 17, the combustion air flows in a direction of flow 61 which is likewise oriented in the direction of the longitudinal center axis 76 and runs approximately parallel to the direction of flow 91. The direction of flow 61 encloses an angle $\beta$ of advantageously more than about 45°, in particular more than about 75°, with a direction of flow 82 in the carburetor 15. In the exemplary embodiment, the angle $\beta$ is approximately 90°. As FIG. 5 also shows, a compensation port 57, to which a compensation connection 81, shown in FIG. 3, of the carburetor 15 is attached, is guided on the air guiding component 11.

As FIG. 6 shows, in an exemplary embodiment, the mixture port 17 has a second section 49, which is arranged upstream of the third section 50. In the second section 49, the combustion air flows in a direction of flow 60 which is oriented in the direction of the longitudinal center axis 76 of the air trunking 63 and runs in the opposite direction to the direction of flow 61 in the third section 50 of the mixture port 17. A deflecting section 85, in which the flow is deflected from the direction of flow 60 into the direction of flow 61, extends between the second section 49 and the third section 50 of the mixture port 17. Accordingly, a deflection of the direction of flow through about 180° takes place in the deflecting section 85. Formed on the cover component 55 is a deflecting face 53, which extends in a concavely curved manner and deflects the flow.

The second section 49 of the mixture port 17 is bounded by an intermediate wall 56, which is integrally formed on the cover component 55. The intermediate wall 56 is also shown in FIG. 7. The intermediate wall 56 separates a first section 48 of the mixture port 17 from the second section 49. In the first section 48, the sucked-in combustion air flows in a direction of flow 59 which is oriented in the direction of the longitudinal center axis 76 and runs in the direction of the third direction of flow 61 and in the opposite direction to the second direction of flow 60. The first section 48 is connected to the clean side 14 of the air filter (FIG. 3) via the mixture port opening 73. As FIG. 7 also shows, a deflecting section 84, in which the flow is deflected from the direction of flow 59 into the direction of flow 60, i.e. through about 180°, is arranged between the first section 48 and the second section 49. Integrally formed on the air guiding component 11 is a deflecting face 54, which is concavely curved and deflects the flow. The intermediate wall 56 is at a spacing from the deflecting face 54, such that a connecting opening 75 is formed between the sections 48 and 49.

As FIG. 6 shows, in an exemplary embodiment, the compensation port 57 is guided in the air guiding component 11 and opens onto the clean side 14 of the air filter 13 at a compensation opening 58. The compensation opening 58 is covered by the covering wall 67 and opens onto the side remote from the mixture port opening 73, as FIG. 4 also shows. The compensation port 57 is also shown in FIG. 8.

Figure 15:
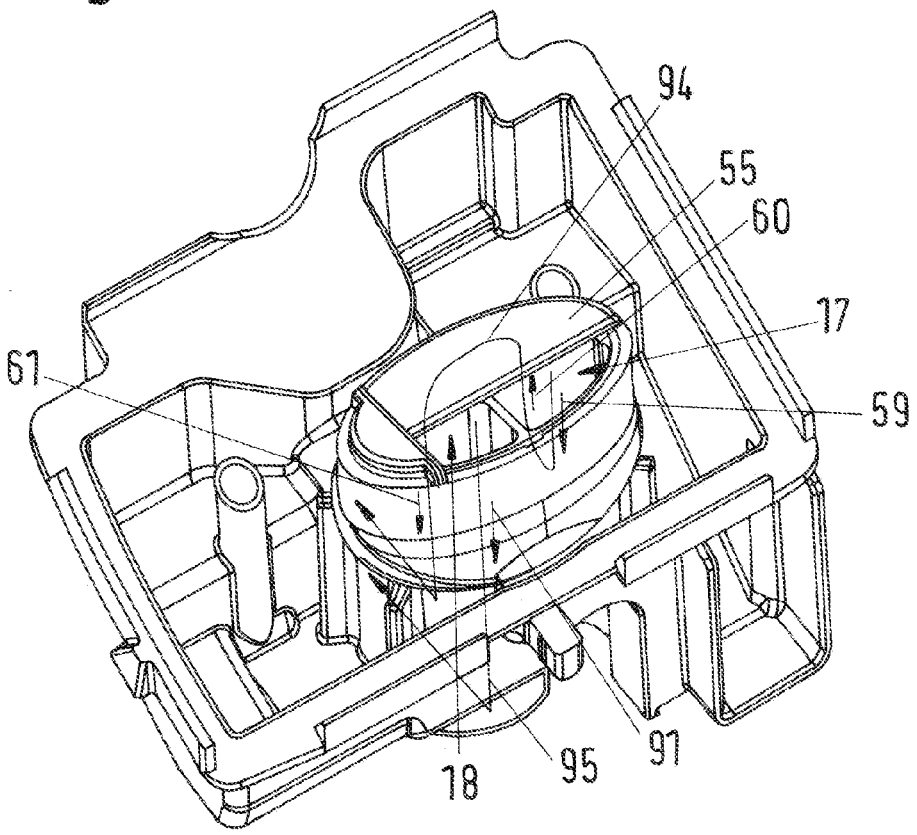
FIG. 15 shows a perspective illustration of the intake device from FIG. 4 without the air filter, with a schematic illustration of the direction of flow in the air port and mixture port.

As FIGS. 4, 5 and 15 show, in an exemplary embodiment, air flows through the airport opening 74 into the first section 45 of the air port 18, is deflected through about 90° in the air guiding component 11 and then flows into the carburetor 15. Combustion air for the mixture port 17 flows through the mixture port opening 73 into the first section 48 (FIG. 7) of the mixture port 17, is deflected through about 180° at the first deflecting section 84 and flows through the second section 49 of the mixture port 17 in the direction of the cover component 55. At the cover component 55, the flow is again deflected through about 180° and then flows in the third section 50 of the mixture port 17 in the direction of flow 61 away from the cover component 55, as FIG. 6 shows. As FIG. 5 shows, the flow from the air guiding component 11 is then deflected by the angle β and flows into the carburetor 15. In FIG. 15, the direction of flow of the combustion air through the mixture port 17 is indicated schematically by an arrow 94 and the flow through the airport 18 is indicated schematically by an arrow 95. The directions of flow 59, 60, 61, 91 in the sections 48, 49, 50, 45 of the ports 17 and 18 are also shown in FIG. 15.

The deflections in the first deflecting section 84 and in the second deflecting section 85 take place in planes which are perpendicular to one another in the exemplary embodiment and correspond to the section planes in FIGS. 6 and 7. The first section 48 and the second section 49 are located alongside one another in a first section plane, shown in FIG. 7, and the second section 49 and the third section are located alongside one another in a second section plane, shown in FIG. 6. The two section planes are, as shown in FIG. 4, advantageously oriented perpendicularly to one another and are advantageously parallel to the longitudinal center axis 76 of the air trunking 63. This arrangement of the sections 48, 49 and 50 produces a compact structure.

Figure 8:
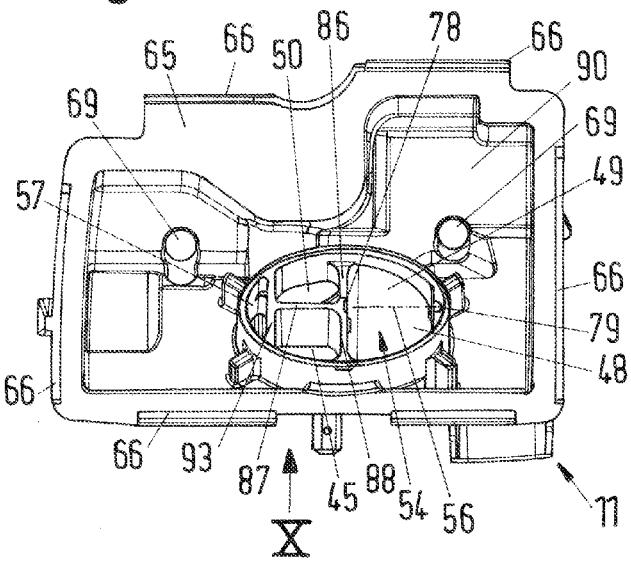
FIG. 8 shows a side view of the air guiding component of the intake device from FIG. 4 in the direction of the arrow IV in FIG. 3.
Figure 9:
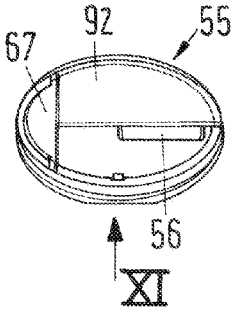
FIG. 9 shows a side view of the cover element of the intake device from FIG. 4 in the direction of the arrow IV in FIG. 3.

FIGS. 8 to 13 show an exemplary embodiment of the structure of the air guiding component 11 and of the cover component 55 in detail. The mixture port 17 and the air port 18 are bounded, downstream of the carburetor 15, only by the air trunking 63 and the cover component 55 with the walls respectively integrally formed on the air trunking 64 and cover component 55. The air guiding component 11 and the cover component 55 are configured such that they can be manufactured easily from plastics material in an injection-molding process. FIG. 8 shows an embodiment of the arrangement of the sections 48, 49, 50 and 45 of the ducts 17, 18 in the air trunking 63. The compensation port 57 is guided laterally in the air trunking 63. The remaining cross section of the air trunking 63 is subdivided into approximately four cross-sectional area parts of equal size, in each of which one of the sections 48, 49, 50 and 45 is arranged. The sections 49 and 50 are, as FIG. 6 also shows, covered by a wall 92 of the cover component 55 with respect to the clean side 14 of the air filter 13. The deflecting face 53 is arranged on the wall 92.

The sections 45 and 48 are, as in particular FIG. 4 shows, open toward the clean space 14 of the air filter 13. The sections 48 and 49 are separated from one another by an intermediate wall 56, which is indicated by dashed lines in FIG. 8. The intermediate wall 56 is integrally formed on the cover component 55. The sections 49 and 50 are separated from one another by an intermediate wall 86. The sections 45 and 50 are separated from one another by an intermediate wall 87 and the sections 45 and 48 by an intermediate wall 88. The sections 50 and 45 are separated from the compensation port 57 via an intermediate wall 93. The intermediate walls 86, 87, 88 and 93 are part of the air trunking 63 and are formed in one piece with the air guiding component 11. As FIG. 8 also shows, the air trunking 63 has grooves 78 and 79, in which the intermediate wall 56 of the cover component 55 is guided. The guidance of the wall 56 in the grooves 78 and 79 produces a stable arrangement and sufficiently good sealing between the sections 48 and 49 of the mixture port 17.

Figure 10:
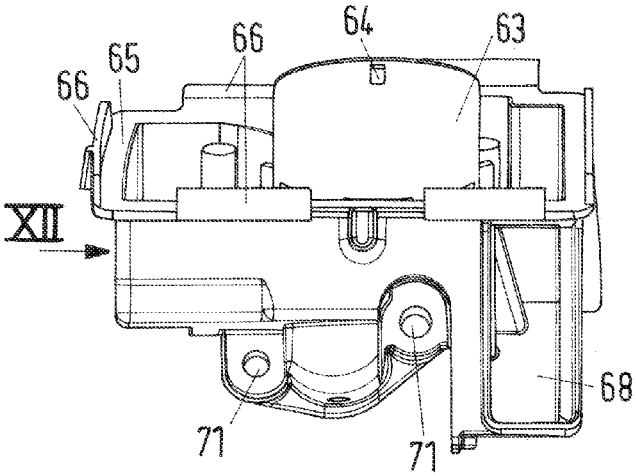
FIG. 10 shows a side view in the direction of the arrow X in FIG. 8.
Figure 11:
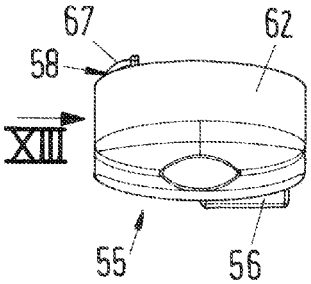
FIG. 11 shows a side view in the direction of the arrow XI in FIG. 9.
Figure 12:
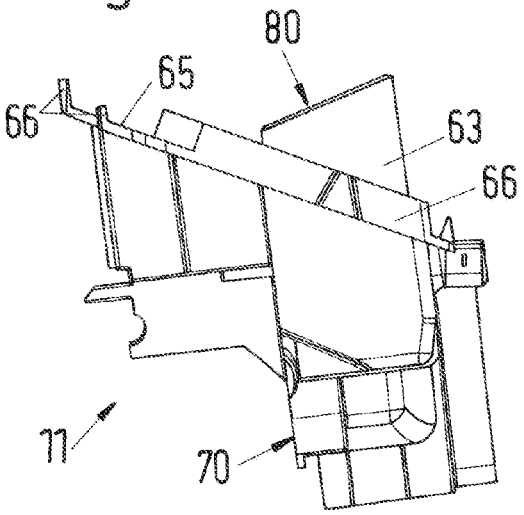
FIG. 12 shows a side view in the direction of the arrow XII in FIG. 10.
Figure 13:
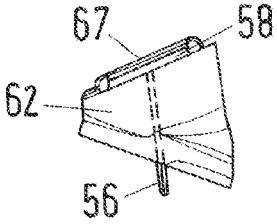
FIG. 13 shows a side view in the direction of the arrow XIII in FIG. 11.
Figure 14:
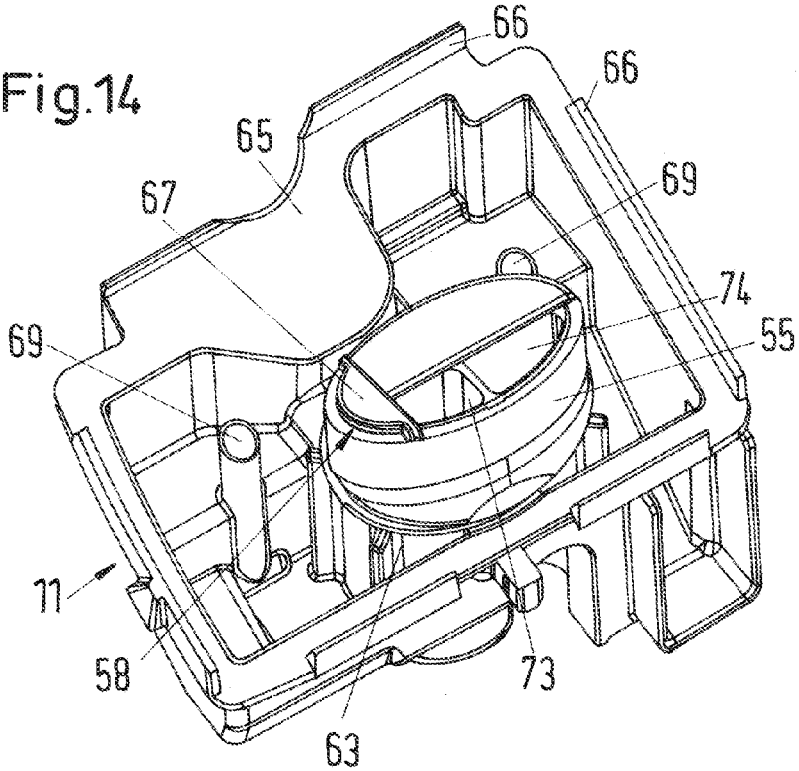
FIG. 14 shows a perspective illustration of the intake device from FIG. 4 without the air filter.

As FIG. 10 shows, in an exemplary embodiment, the air trunking 63 has a latching lug 64. The cover component 55 can be latched on the latching lug 64. FIGS. 11 and 13 also show the arrangement of the intermediate wall 56 on the cover component 55. The cover component 55 has the rim 62, which engages over the air trunking 63 (FIGS. 5 to 7). The intermediate wall 56 projects beyond the rim 62 into the air trunking 63. The design of the covering wall 67 is also shown in detail in FIGS. 9, 11 and 13. As FIG. 10 shows, the air guiding component 11 has an intake opening 68, which connects the interior bounded by the base 90 (FIG. 8) and the air filter 13 (FIG. 3) with the environment. FIG. 12 shows a carburetor connection face 70 of the air guiding component 11, the carburetor 15 being arranged on said carburetor connection face 70. Furthermore, the design of the positioning rim 66 is shown. FIG. 10 also shows fastening openings 71, via which the air guiding component 11 can be fixed with the carburetor 15 on the housing 2. The arrangement of the cover component 55 on the air trunking 63 is also shown in FIG. 14. As FIG. 14 also shows, the cover component 55 rests against the bearing surface 65 and is additionally positioned on the air guiding component 11 thereby.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

The invention claimed is:

1. An internal combustion engine comprising:

an intake device, wherein the intake device has an air filter and at least one port, via which combustion air is sucked in from a clean side of the air filter to the internal combustion engine, wherein the air filter comprises a filter material that removes dirt, wherein the intake device has air trunking, in which at least a first section and a second section of the port are guided, wherein the air trunking has a longitudinal center axis, wherein the combustion air flows in the first section of the port in a first direction of flow which runs in the direction of the longitudinal center axis, and wherein the combustion air flows in the second section of the port in a second direction of flow which is oriented in the opposite direction to the first direction of flow and in the direction of the longitudinal center axis, wherein the air trunking extends through the air filter and further extends into a dirty side of the air filter and into a clean side of the air filter.

2. The internal combustion engine according to claim 1, wherein the first section and the second section of the port extend through the air filter, and a third section of the port is guided in the air trunking, wherein the direction of flow in the third section corresponds to the direction of flow in the first section.

3. The internal combustion engine according to claim 1, wherein the sections of the port in the air trunking are separated from one another by at least one intermediate wall.

4. The internal combustion engine according to claim 3, wherein the port extends in a straight line in the first section and in the second section, and a deflecting section is arranged between the first section and the second section.

5. The internal combustion engine according to claim 4, wherein a curved deflecting face is arranged at the deflecting section.

6. The internal combustion engine according to claim 1, wherein a cover component is arranged on the air trunking, and wherein the sections of the port that are guided in the air trunking are bounded by the air trunking and the cover component.

7. The internal combustion engine according to claim 6, wherein a deflecting section is formed on the cover component.

8. The internal combustion engine according to claim 1, wherein the intake device has a mixture port, into which fuel is fed, and wherein the intake device has an air port, which serves to feed scavenging air into at least one transfer port of the internal combustion engine.

9. The internal combustion engine according to claim 8, wherein the mixture port and the air port are guided in the air trunking.

10. The internal combustion engine according to claim 8, wherein the port which has the first section and the second section is the mixture port.

11. The internal combustion engine according to claim 8, wherein the air port and the mixture port open onto the clean side of the air filter at an end side of the air trunking.

12. The internal combustion engine according to claim 1, wherein the intake device has a carburetor for feeding fuel.

13. The internal combustion engine according to claim 12, wherein a compensation port, which is connected to a compensation connection of the carburetor, is guided in the air trunking.

14. The internal combustion engine according to claim 13, wherein the compensation port is covered at the end side of the air trunking and opens, transversely to the longitudinal center axis of the air trunking, onto the clean side of the air filter.

15. The internal combustion engine according to claim 12, wherein the air port and the mixture port are guided in the carburetor in a common port pipe of the carburetor housing.

16. The internal combustion engine according to claim 12, wherein the direction of flow in the first section of the port encloses an angle ($\beta$) of more than 45° with the direction of flow in the carburetor.

17. An internal combustion engine comprising:

an intake device, wherein the intake device has an air filter and at least one port, via which combustion air is sucked in from a clean side of the air filter to the internal combustion engine, wherein the air filter comprises a filter material that removes dirt, wherein the intake device has air trunking, in which at least a first section and a second section of the port are guided, wherein the air trunking has a longitudinal center axis, wherein the combustion air flows in the first section of the port in a first direction of flow which runs in the direction of the longitudinal center axis, and wherein the combustion air flows in the second section of the port in a second direction of flow which is oriented in the opposite direction to the first direction of flow and in the direction of the longitudinal center axis, wherein the air filter extends in a plane which encloses an angle ($\alpha$) of 40° to 80° with the longitudinal center axis of the air trunking.

18. An internal combustion engine comprising:

an intake device, wherein the intake device has an air filter and at least one port, via which combustion air is sucked in from a clean side of the air filter to the internal combustion engine, wherein the air filter comprises a filter material that removes dirt, wherein the intake device has air trunking, in which at least a first section and a second section of the port are guided, wherein the air trunking has a longitudinal center axis, wherein the combustion air flows in the first section of the port in a first direction of flow which runs in the direction of the longitudinal center axis, and wherein the combustion air flows in the second section of the port in a second direction of flow which is oriented in the opposite direction to the first direction of flow and in the direction of the longitudinal center axis, wherein a cover component is arranged on the air trunking, and wherein the sections of the port that are guided in the air trunking are bounded by the air trunking and the cover component, wherein an intermediate wall is fixed to the cover component, said intermediate wall projecting into the air trunking and separating two sections of the port from one another.

19. The internal combustion engine according to claim 18, wherein the intermediate wall is guided in at least one groove in the air trunking.

* * * * *